US007426758B1

(12) United States Patent
Jones

(10) Patent No.: US 7,426,758 B1
(45) Date of Patent: Sep. 23, 2008

(54) CRIB ASSEMBLY

(76) Inventor: Sandy A. Jones, 3761 Grant Ave., Apartment #E14, Ogden, UT (US) 84405

( * ) Notice: Subject to any disclaimer, the term of this patent is extended or adjusted under 35 U.S.C. 154(b) by 12 days.

(21) Appl. No.: 11/650,533

(22) Filed: Jan. 8, 2007

(51) Int. Cl.
*A47D 7/00* (2006.01)

(52) U.S. Cl. ..... 5/100; 5/93.1; 256/25; 256/26; 292/137; 292/146

(58) Field of Classification Search ..... 5/93.1–100, 5/425, 430; 256/26, 65.13; 292/137.138, 292/145, 146, 150, 338
See application file for complete search history.

(56) References Cited

U.S. PATENT DOCUMENTS 949,389 A * 2/1910 Almgren ..... 5/93.1
2,477,231 A * 7/1949 Bourdon ..... 5/93.1
2,533,983 A * 12/1950 Weigle et al. ..... 5/2.1
2,555,160 A * 5/1951 Schwartz ..... 5/93.1
3,900,907 A 8/1975 Muldor
4,703,524 A 11/1987 Brunner et al.
4,715,074 A 12/1987 Wallace et al.
4,882,799 A 11/1989 Shapiro
4,959,878 A * 10/1990 Essek ..... 5/424
5,054,138 A 10/1991 Wesley
5,093,945 A 3/1992 Schoonover et al.
5,485,699 A * 1/1996 Gabhart ..... 49/394
D382,418 S 8/1997 Proano et al.
5,742,959 A * 4/1998 Froelich ..... 5/93.1

* cited by examiner

*Primary Examiner*—Alexander Grosz

(57) ABSTRACT

A crib assembly for permitting access to an infant in a crib without lifting the infant over the top of the crib includes a base panel supporting an infant when the infant is placed on the base panel. Each of a pair of opposing ends of the base panel has one of a first and second end walls coupled thereto and extending upwardly therefrom. A front wall is hingedly coupled to the first end wall and is pivotal between a closed position and an open position. The front wall inhibits the infant sliding over the front edge of the base panel when the front wall is in the closed position.

7 Claims, 6 Drawing Sheets

CRIB ASSEMBLY

BACKGROUND OF THE INVENTION

1. Field of the Invention

The present invention relates to crib assembly structures and more particularly pertains to a new crib assembly structure for permitting access to an infant in a crib without lifting the infant over the top of the crib.

2. Description of the Prior Art

The use of crib structures is known in the prior art. While these devices fulfill their respective, particular objectives and requirements, the need remains for a device that has certain improved features that allow a front wall of the device to pivot to allow access to an infant positioned in the device. Additionally, the wall of the device is capable of being latched in a closed position to inhibit inadvertent pivoting of the front wall.

SUMMARY OF THE INVENTION

The present invention meets the needs presented above by generally comprising a base panel supporting an infant when the infant is placed on the base panel. Each of a pair of opposing ends of the base panel has one of a first and second end walls coupled thereto and extending upwardly therefrom. The first and second end walls inhibit the infant inadvertently sliding over one of the opposing ends of the base panel. A front wall is hingedly coupled to the first end wall. The front wall is pivoted between a closed position and an open position. The closed position is defined by the front wall extending along a front edge of the base panel and between the first and second end walls. The front wall inhibits the infant sliding over the front edge of the base panel when the front wall is in the closed position. The open position is defined by the front wall is pivoted away from the front edge to permit access to the base panel when the infant is positioned on the base panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
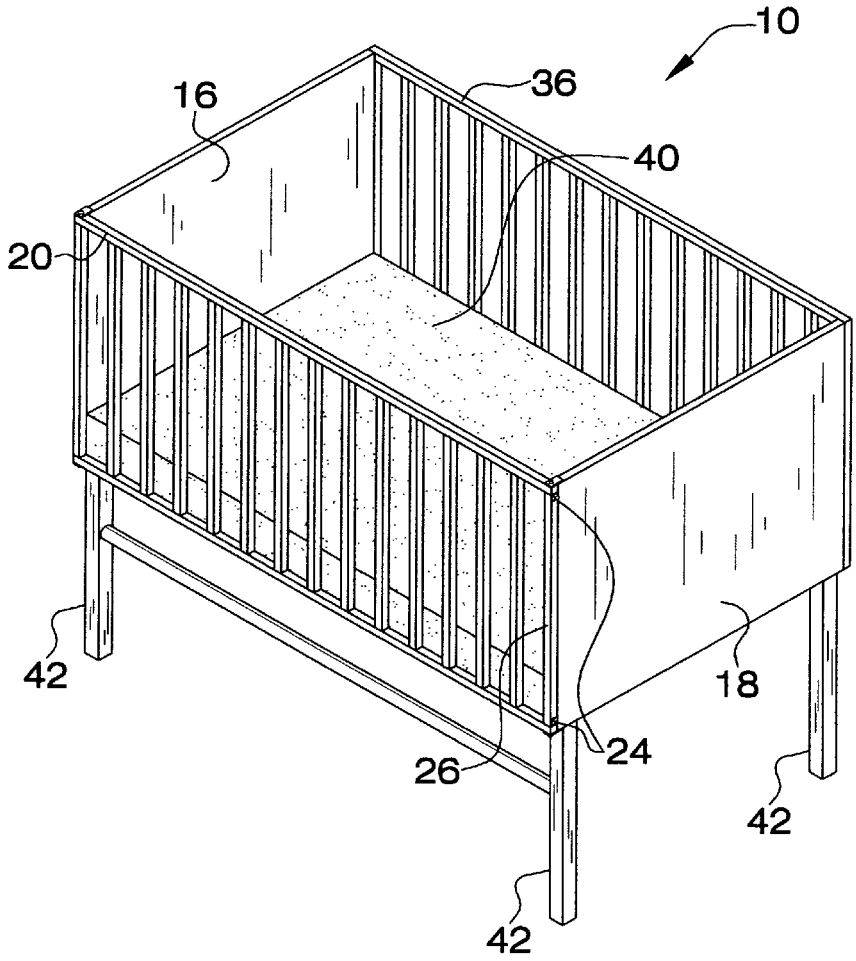
FIG. 1 is a perspective view of a crib assembly according to the present invention.
Figure 2:
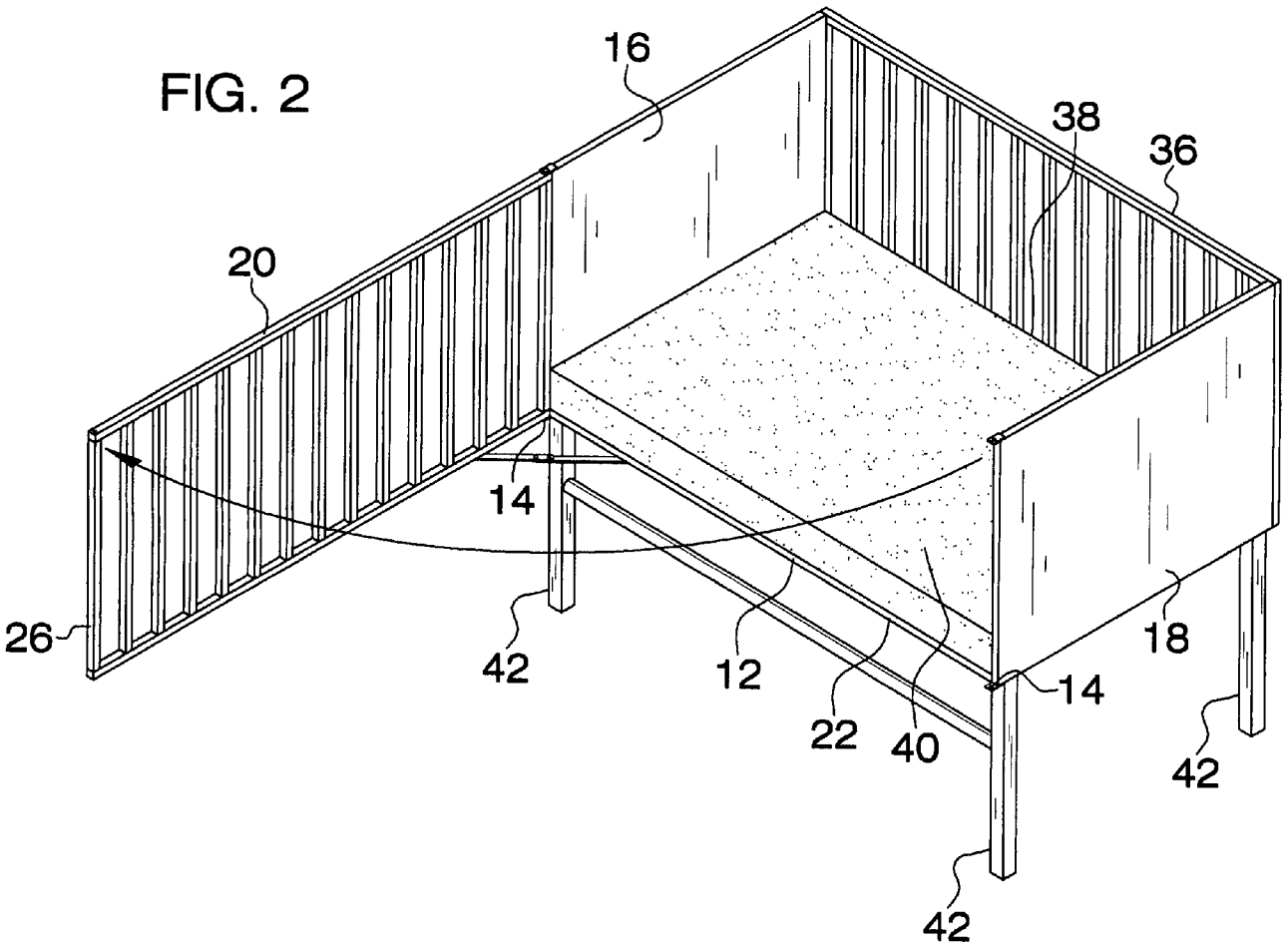
FIG. 2 is a perspective view of the present invention showing the front wall in the open position.
Figure 3:
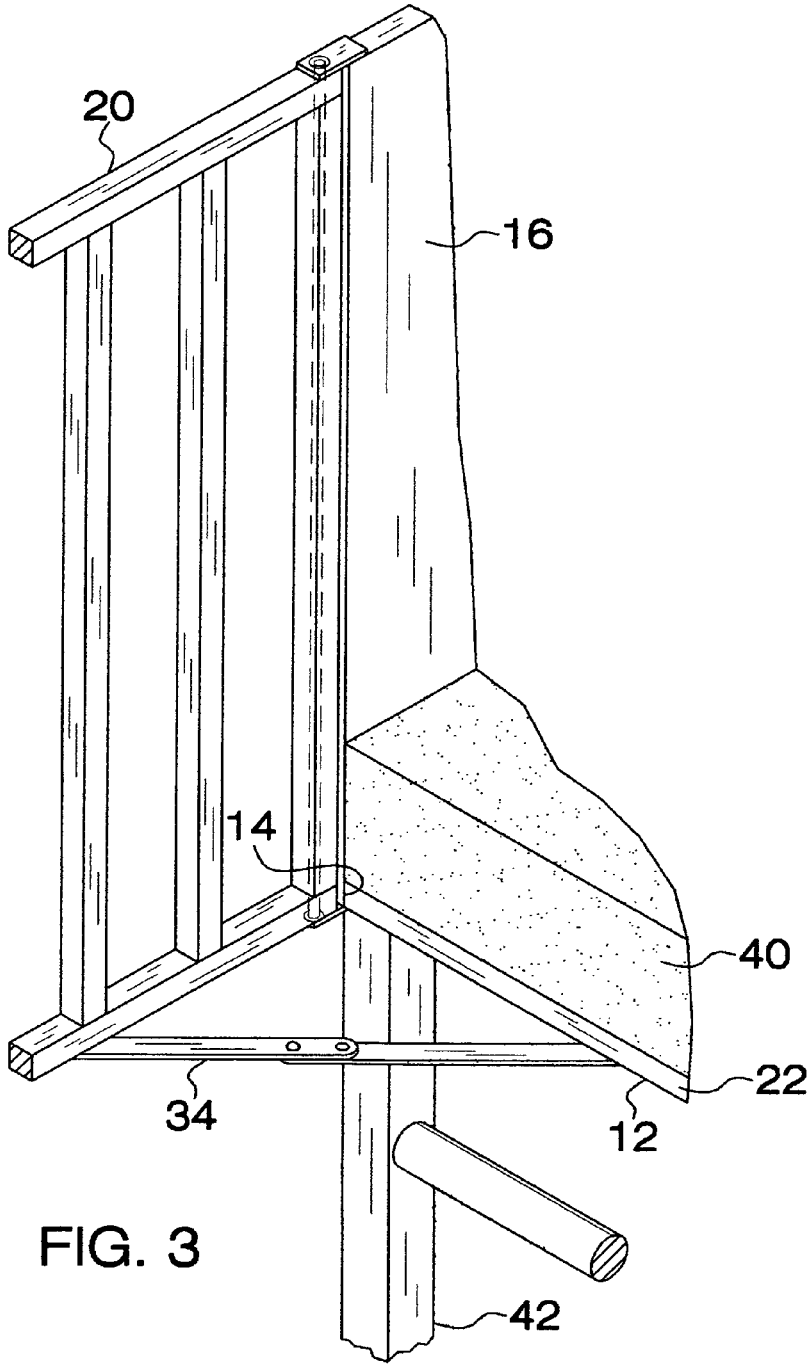
FIG. 3 is an enlarged perspective view of the connection of the front wall and the first wall of the present invention.
Figure 4:
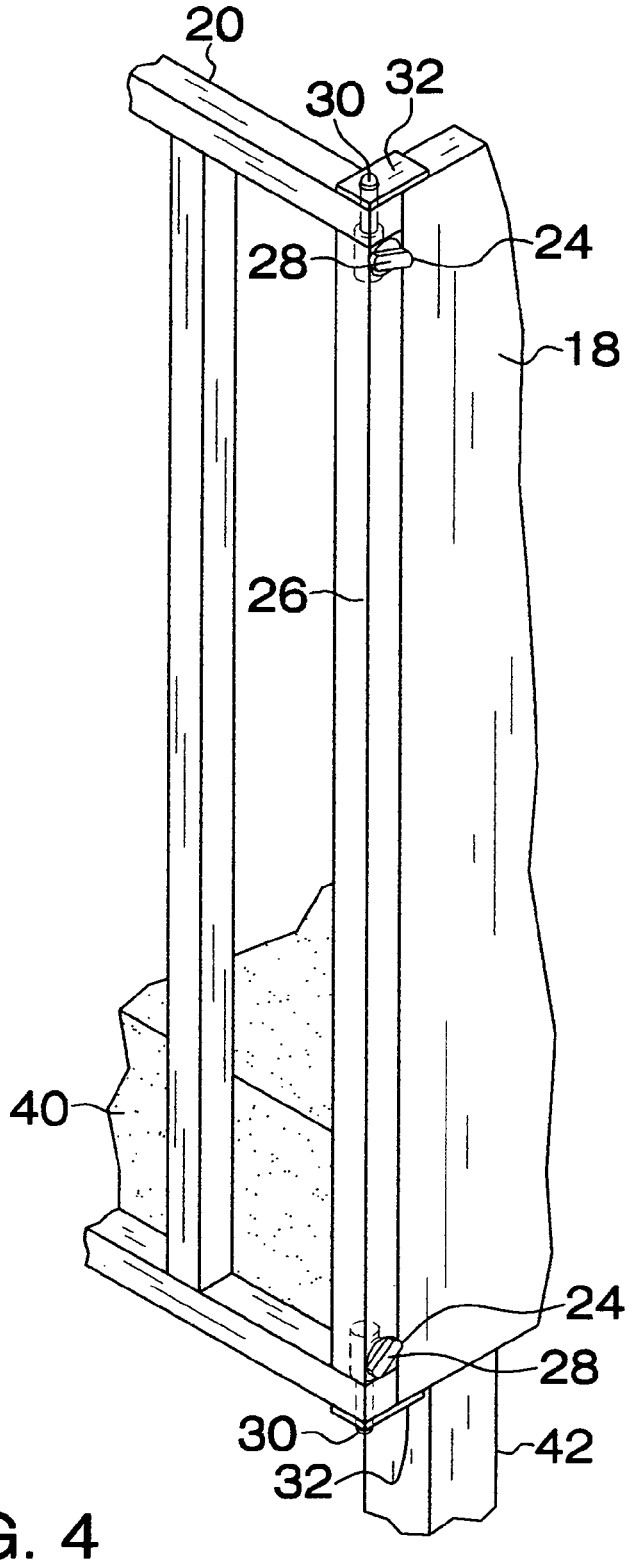
FIG. 4 is an enlarged perspective view of the second end wall and the free end of the front wall of the present invention in the closed position.
Figure 5:
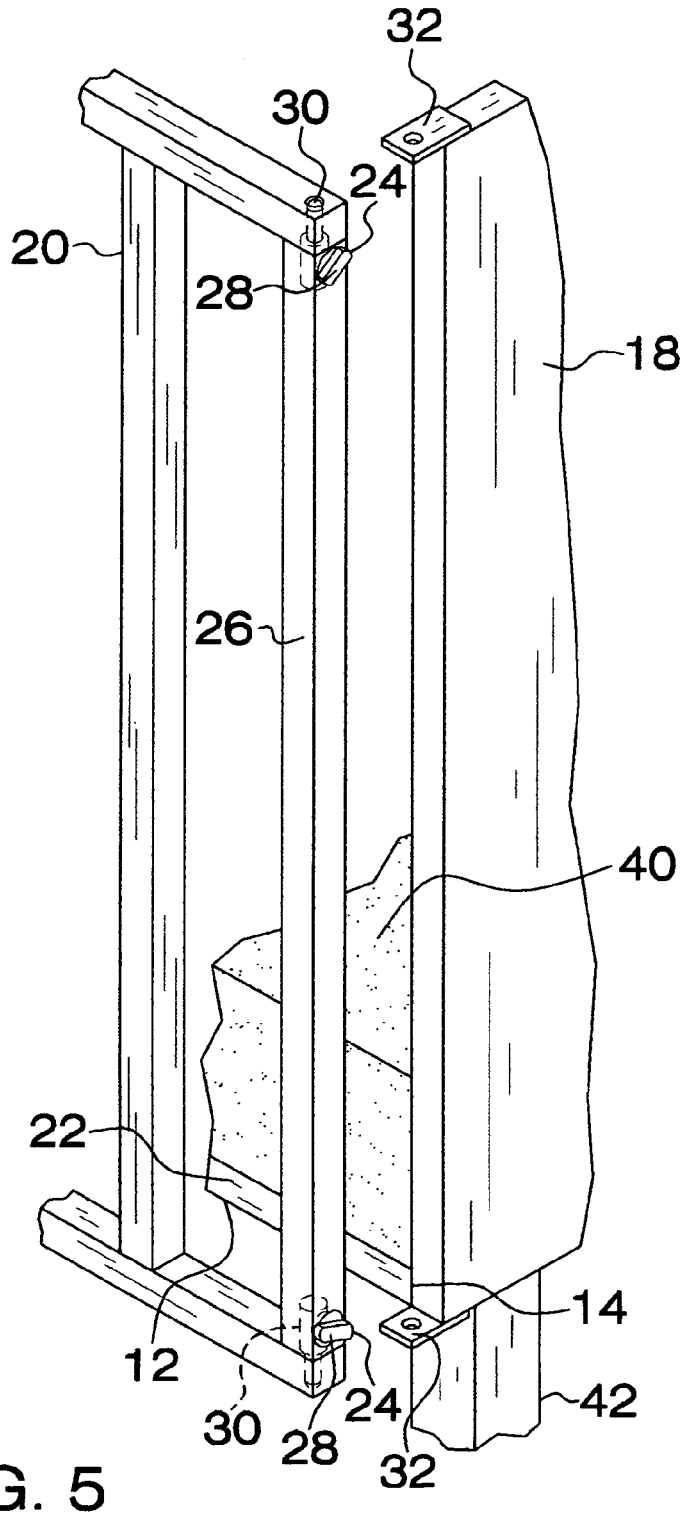
FIG. 5 is an enlarged perspective view of the second end wall and the free end of the front wall of the present invention being pivoted to the open position.
Figure 6:
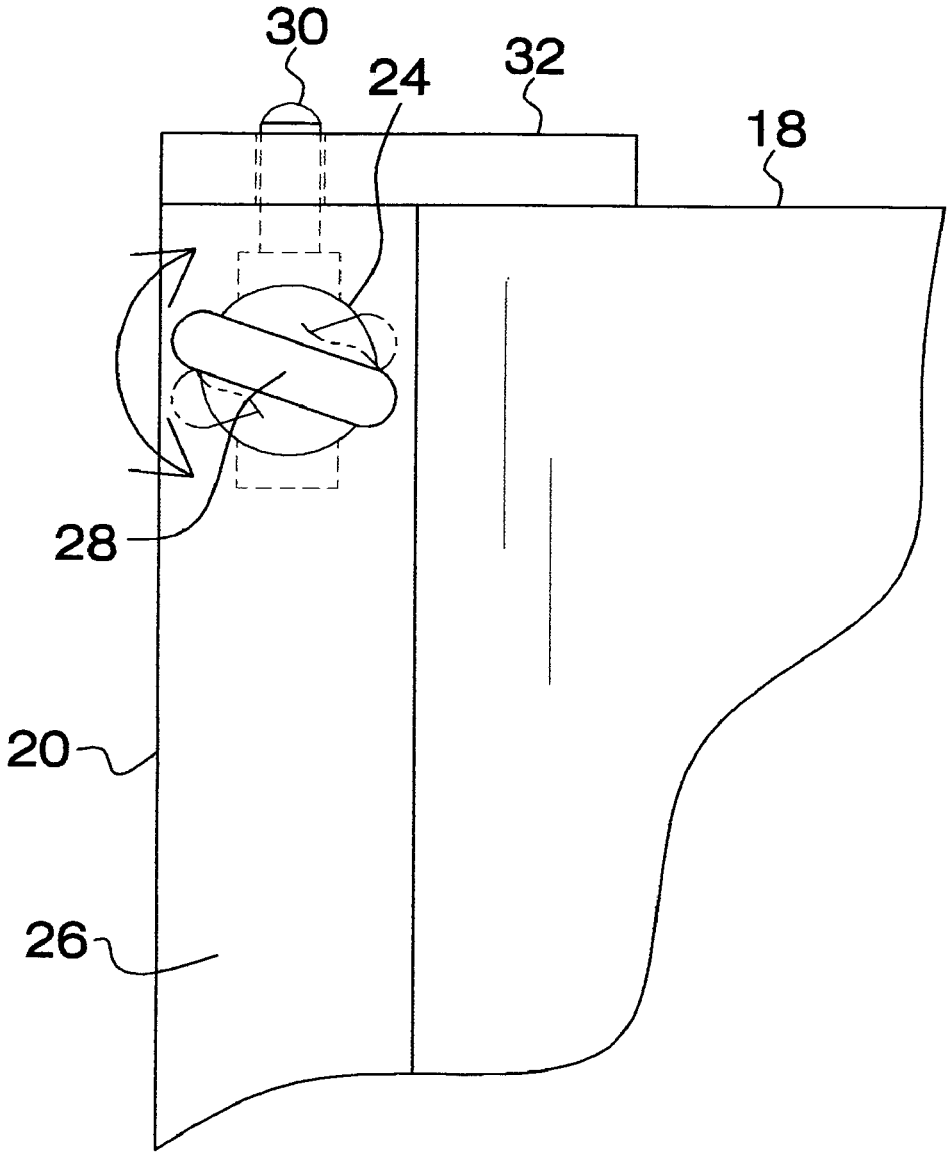
FIG. 6 is an enlarged side view of the latch assembly of the present invention.

With reference now to the drawings, and in particular to FIGS. 1 through 6 thereof, a new crib structure embodying the principles and concepts of the present invention and generally designated by the reference numeral 10 will be described.

As best illustrated in FIGS. 1 through 6, the crib assembly 10 generally comprises a base panel 12 supporting an infant when the infant is placed on the base panel 12. Each of a pair of opposing ends 14 of the base panel 12 has one of a first 16 and second 18 end walls coupled thereto and extending upwardly therefrom. The first 16 and second 18 end walls inhibit the infant inadvertently sliding over one of the opposing ends 14 of the base panel 12.

A front wall 20 is hingedly coupled to the first end wall 16. The front wall 20 is pivoted between a closed position and an open position. The closed position is defined by the front wall 20 extending along a front edge 22 of the base panel 12 and between the first 16 and second 18 end walls. The front wall 20 inhibits the infant sliding over the front edge 22 of the base panel 12 when the front wall 20 is in the closed position. The open position is defined by the front wall 20 being pivoted away from the front edge 22 to permit access to the base panel 12 when the infant is positioned on the base panel 12.

At least one latch assembly 24 is coupled to a free end 26 of the front wall 20. The at least one latch assembly 24 engages the second end wall 18 to selectively secure the front wall 20 in the closed position. The at least one latch assembly 24 includes a dial 28 rotatably coupled to the front wall 20 and positioned adjacent to the free end 26 of the front wall 20.

The at least one latch assembly 24 also includes a bolt 30. The bolt 30 is slidably positioned in the front wall 20. The dial 28 is mechanically coupled to the bolt 30, wherein rotation of the dial 28 alternately extends and retracts the bolt 30 with respect to the front wall 20. The latch assembly 24 includes a tab 32 attached to the second end wall 18 and is aligned with the bolt 30. The bolt 30 is extended through the tab 32 to secure the front wall 20 in the closed position. Each latch assembly 24 includes one bolt 30, one tab 32 and one dial 28. As shown in the figures, two latch assemblies 24 may be utilized.

A retaining armature 34 is coupled to and extends between the front wall 20 and the base panel 12. The retaining armature 34 releasably secures the front wall 20 in the open position. The retaining armature 34 is folded to permit the front wall 20 to pivot to the closed position.

A rear wall 36 is coupled to a rear edge 38 of the base panel 12 and the first 16 and second 18 end walls. The rear wall 36 extends between the first 16 and second 18 end walls. The rear wall 36 inhibits the infant sliding over the rear edge 38 of the base panel 12.

A mattress 40 is positionable on the base panel 12. The mattress 40 cushions the infant positioned on the base panel 12. Each of a plurality of legs 42 is attached to and supports the base panel 12 above a support surface.

In use, the dial 28 of the at least one latch assembly 24 is rotated to retract the bolt 30 into the front wall 20. The front wall 20 is then pivoted to the open position to allow access to the mattress 40 and the infant positioned on the mattress 40. The retaining armature 34 extends between the base panel 12 and the front wall 20 to keep the front wall 20 in the open position. The retaining armature 34 is folded to allow the front wall 20 to be pivoted to the closed position to enclose the infant in the crib assembly. The dial 28 is then rotated to extend the bolt 30 through the tab 32 to secure the front wall 20 in the closed position.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A crib for supporting an infant, said crib comprising:

a base panel supporting the infant when the infant is placed on said base panel;

a first end wall and a second end wall, each of a pair of opposing ends of said base panel having one of said first and second end walls coupled thereto and extending upwardly therefrom, said first and second end walls inhibiting the infant inadvertently sliding over one of said opposing ends of said base panel;

a front wall being hingedly coupled to said first end wall, said front wall being pivoted between a closed position and an open position, said closed position being defined by said front wall extending along a front edge of said base panel and between said first and second end walls, said front wall inhibiting the infant sliding over said front edge of said base panel when said front wall is in said closed position, said open position being defined by said front wall being pivoted away from said front edge to permit access to said base panel when the infant is positioned on said base panel;

a rear wall being coupled to a rear edge of said base panel and said first and second end walls, said rear wall extending between said first and second end walls, said rear wall inhibiting the infant sliding over said rear edge of said base panel;

at least one latch assembly being coupled to a free end of said front wall, said at least one latch assembly engaging said second end wall to selectively secure said front wall in said closed position;

and a retaining armature being coupled to and extending between said front wall and said base panel, said retaining armature releasably securing said front wall in said open position, said retaining armature being foldable to permit said front wall to pivot to said closed position.

2. The crib according to claim 1, wherein said at least one latch assembly includes a dial being rotatably coupled to said front wall and positioned adjacent to said free end of said front wall.

3. The crib according to claim 2, wherein said at least one latch assembly includes a bolt, said bolt being slidably positioned in said front wall, said dial being mechanically coupled to said bolt, wherein rotation of said dial alternately extends and retracts said bolt with respect to said front wall.

4. The crib according to claim 3, wherein said latch assembly includes a tab attached to said second end wall and being aligned with said bolt, said bolt being extended through said tab to secure said front wall in said closed position.

5. The crib according to claim 1, further comprising a mattress being positionable on said base panel, said mattress cushioning the infant positioned on said base panel.

6. The crib according to claim 1, further comprising a plurality of legs each being attached to and supporting said base panel above a support surface.

7. A crib for supporting an infant, said crib comprising:

a base panel supporting the infant when the infant is placed on said base panel;

a first end wall and a second end wall, each of a pair of opposing ends of said base panel having one of said first and second end walls coupled thereto and extending upwardly therefrom, said first and second end walls inhibiting the infant inadvertently sliding over one of said opposing ends of said base panel;

a front wall being hingedly coupled to said first end wall, said front wall being pivoted between a closed position and an open position, said closed position being defined by said front wall extending along a front edge of said base panel and between said first and second end walls, said front wall inhibiting the infant sliding over said front edge of said base panel when said front wall is in said closed position, said open position being defined by said front wall being pivoted away from said front edge to permit access to said base panel when the infant is positioned on said base panel;

at least one latch assembly being coupled to a free end of said front wall, said at least one latch assembly engaging said second end wall to selectively secure said front wall in said closed position, said at least one latch assembly including a dial being rotatably coupled to said front wall and positioned adjacent to said free end of said front wall, said at least one latch assembly including a bolt, said bolt being slidably positioned in said front wall, said dial being mechanically coupled to said bolt, wherein rotation of said dial alternately extends and retracts said bolt with respect to said front wall, said latch assembly including a tab attached to said second end wall and being aligned with said bolt, said bolt being extended through said tab to secure said front wall in said closed position;

a retaining armature being coupled to and extending between said front wall and said base panel, said retaining armature releasably securing said front wall in said open position, said retaining armature being folded to permit said front wall to pivot to said closed position;

a rear wall being coupled to a rear edge of said base panel and said first and second end walls, said rear wall extending between said first and second end walls, said rear wall inhibiting the infant sliding over said rear edge of said base panel;

a mattress being positionable on said base panel, said mattress cushioning the infant positioned on said base panel; and a plurality of legs each being attached to and supporting said base panel above a support surface.

* * * * *